United States Patent [19]

Trousdell et al.

[11] Patent Number: 4,875,830

[45] Date of Patent: Oct. 24, 1989

[54] FLANGED LADDER SEAL

[75] Inventors: Edmund D. Trousdell, Tolland; Robert F. Kasprow, Wethersfield, both of Conn.

[73] Assignee: United Technologies Corporation, Hartford, Conn.

[21] Appl. No.: 756,462

[22] Filed: Jul. 18, 1985

[51] Int. Cl.[4] ..... F01D 5/30

[52] U.S. Cl. ..... 416/215; 416/193 A; 416/218

[58] Field of Search ..... 416/215, 216, 217, 218, 416/219 R, 219 A, 221, 190, 500, 193 A

[56] References Cited

U.S. PATENT DOCUMENTS

| | | | |
|---|---|---|---|
| 902,915 | 11/1908 | Roth | 416/218 |
| 922,581 | 5/1909 | Hanzlik et al. | 416/218 |
| 2,717,554 | 9/1955 | Stalker | 416/219 |
| 2,948,505 | 8/1960 | Sonder | 416/500 |
| 3,972,645 | 8/1976 | Kasprow | 416/218 |
| 4,464,096 | 8/1984 | Trousdell et al. | 416/221 |

FOREIGN PATENT DOCUMENTS

| | | | |
|---|---|---|---|
| 849124 | 9/1960 | United Kingdom | 416/215 |

*Primary Examiner*—Robert E. Garrett
*Assistant Examiner*—John T. Kwon
*Attorney, Agent, or Firm*—James M. Rashid

[57] ABSTRACT

In a compressor rotor assembly of an axial flow gas turbine engine, wherein the rotor disk has a circumferential blade retaining slot for receiving the root of each blade of a row of blades, a ladder seal is provided between the slot and the blade platforms to limit the leakage of working medium gases from the flow path and through the slot. During engine operation, the seal moves radially outwardly into sealing relation with the underside surface of each platform. At the same time, radially inwardly extending flanges of the seal move radially outwardly into sealing relation with the sidewalls of the disk slot.

3 Claims, 4 Drawing Sheets

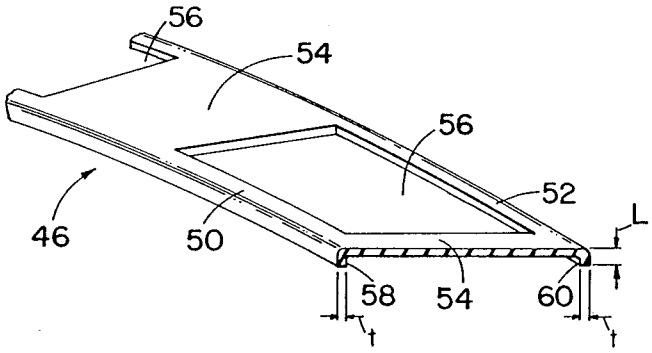
FIG. 3
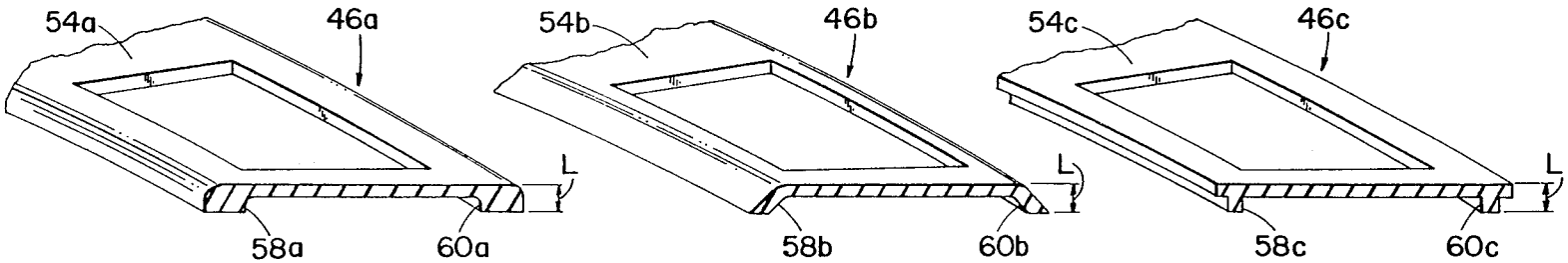
FIG. 7C
FIG. 7B
FIG. 7A

FLANGED LADDER SEAL

TECHNICAL FIELD

The present invention relates to gas turbine engines, and in particular, to blade root seals for rotor assemblies.

BACKGROUND ART

A gas turbine engine has a compression section, a combustion section, and a turbine section. The compression and turbine sections have at least one rotor stage. Each rotor stage includes a disk which rotates about the axis of the engine, and a circumferential row of rotor blades extending radially outwardly from the disk into a flow path of working medium gases. Each blade has a platform which provides a boundary to the flow path. Radially inward of the platform is a blade root which engages a blade retaining slot in the disk. In some rotor designs, the slot extends circumferentially about the rim of the disk.

The platforms of adjacent blades are circumferentially spaced from each other, and working medium gases can leak from the flow path, through the gap between adjacent platforms, and then through the blade retaining slot. Also, the platforms are radially spaced from the disk rim, and the gases can leak under each platform, and through the blade slot. Such leakage of gases, from a region of high pressure to a region of low pressure, is undesireable, as it decreases the operating efficiency of the engine.

Examples of seals for limiting the leakage of gases through a circumferential blade retaining slot of a rotor disk are shown in U.S. Pat. Nos. 3,972,645 and 4,464,096. Both patents describe annular ladder seals, having circumferentially spaced apart crossbars connected at opposite ends by circumferentially extending strips, the crossbars and strips forming a ladder shaped member. The blade retaining slot in these patents includes a circumferential recess having opposed, axially facing sidewalls, and the seal is located within the recess and beneath the blade platforms. Each blade root extends through an opening between adjacent crossbars and engages the slot. In U.S. Pat. No. 3,972,645, the axial width of the seal is equal to the axial width of each blade platform, and each of the crossbars is in overlapping relation to the gap between adjacent blade platforms. During engine operation, centrifugal forces cause the seal to move radially outwardly into contact with the underside of the platforms to seal the gap and limit interplatform leakage of gases. In U.S. Pat. No. 4,464,096, the ladder seal has crossbars which, in the as-fabricated condition, are bowed radially inwardly. When the engine is at rest, the axial width of the seal is less than the distance between the recess sidewalls. During engine operation, the seal is forced radially outwardly into contact with the underside of the blade platforms. This causes the bowed crossbars to be flattened against the platforms, and the seal spreads apart in the axial direction until the circumferential ends of the seal contact the axially facing recess sidewalls. Such contact limits the leakage of gases beneath the platforms and through the blade slot. The as-fabricated axial dimension of the seal, as well as the degree of crossbar bowing, must be precisely controlled to insure that during engine operation, the seal ends will contact their respective sidewalls.

In both of the above referenced patents, if the seal fractures during engine operation, pieces of the seal may enter the gas stream and cause foreign object damage to the engine components. In order to limit the escape of such pieces, radial and axial clearances between the blade platforms and the blade retaining slot in the disk must be minimized, which may complicate machining and assembly of the rotor.

Other patents which indicate the general state of the art in the field of blade root seals are U.S. Pat. Nos. 1,003,892, 1,276,405, 2,299,429, 3,266,771, 3,367,624, 3,700,354, 3,972,645, 4,029,436, 4,101,245, 4,183,720, and 4,455,122.

DISCLOSURE OF THE INVENTION

An object of the present invention is to increase the operation efficiency of a gas turbine engine.

Another object of the present invention is an improved seal for limiting the leakage of working medium gases through the blade attachment area of a rotor disk.

Yet another object of the present invention is a blade root platform seal which is easily installed in the rotor.

According to the present invention, an annular ladder seal, comprising a plurality of circumferentially spaced apart crossbars integral with a pair of circumferentially extending, axially spaced apart strips, is disposed between the blade platforms and a circumferential blade retaining slot of a rotor disk, wherein the slot includes a recess having opposed, axially facing sidewalls, and each seal strip has a circumferential, radially inwardly extending flange axially adjacent to one of the sidewalls, and wherein the blade platforms are circumferentially spaced from each other, and radially spaced from the disk rim, the underside surface of each platform being inclined radially outwardly in opposite axial directions away from the blade root such that during engine operation, centrifugal forces bend the crossbars into sealing relation with the underside surface of adjacent blade platforms to seal the gap between the platforms, and said forces move each seal flange radially outwardly into sealing relation with its respective sidewall surface to seal the gap between the platforms and the disk rim.

A primary advantage of the present invention is the increase in engine efficiency which results from the increased sealing effectiveness of the ladder seal.

Another advantage of the present invention is that the radial clearance between the blade platform and the disk rim can be increased, since the flanges prevent leakage from the gas flow path and beneath the platforms during engine operation. The increase in allowable clearance simplifies machining of the disk and blades, since machining tolerances of both components can be relaxed. Also, the increased clearance allows for easier assembly of the seal to the rotor.

An additional advantage of the present invention is that if any portion of the seal fractures during engine operation, the seal is retained within the blade slot by the flanges which contact the recess sidewalls, thus preventing foreign object damage to the engine components.

The foregoing and other objects, features and advantages of the present invention will become more apparent in the light of the following detailed description of the preferred embodiments thereof as illustrated in the accompanying drawing.

BRIEF DESCRIPTION OF THE DRAWING

FIG. 3 is a perspective view, partly in section, showing the ladder seal of the present invention;

FIGS. 7A–7C are perspective views, partly in section, showing alternate configurations for the seal of the present invention.

BEST MODE FOR CARRYING OUT THE INVENTION

Figure 2:
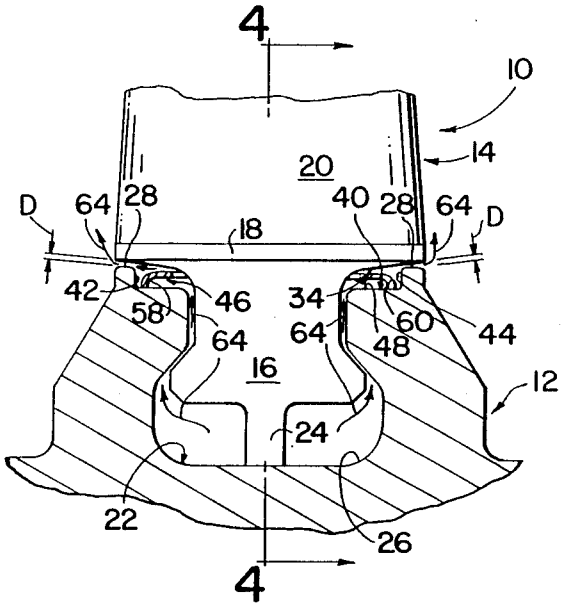
FIG. 2 is a sectional view of the rotor assembly, taken along the lines 2—2 of FIG. 1, and showing the rotor assembly at rest.
Figure 1:
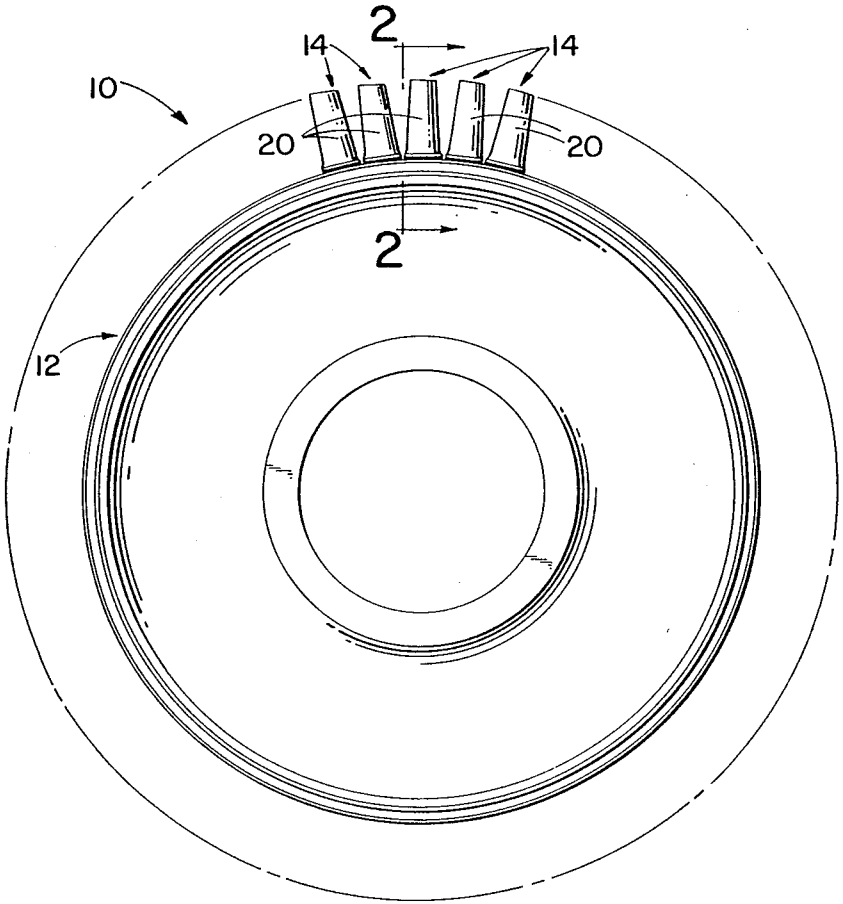
FIG. 1 is a simplified front view of a rotor assembly which incorporates features of the present invention.

As an exemplary embodiment of the present invention, consider a portion of a rotor assembly of a gas turbine engine as shown in FIGS. 1 and 2, and generally represented by the reference numeral 10. The rotor assembly 10 includes a rotor disk 12 and a circumferential row of rotor blades 14 attached to the disk 12. The rotor assembly 10 rotates about an axis which is concentric with the engine axis.

Figure 4:
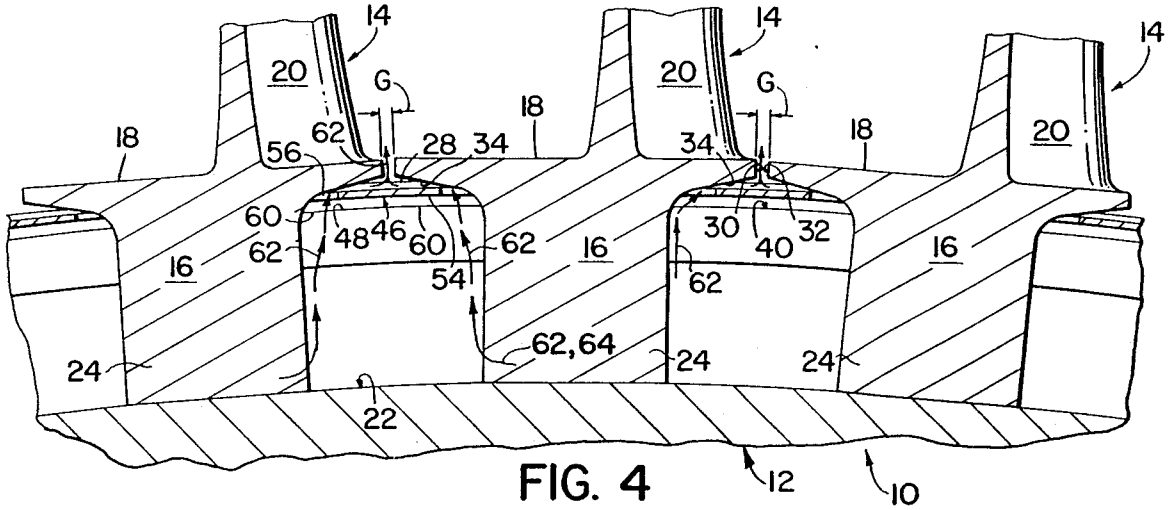
FIG. 4 is a view taken along the lines 4—4 of FIG. 2.

Each blade 14 includes a root 16, a platform 18 radially outward of the root 16, and an airfoil 20 radially outward of the platform 18. The root 16 engages a dove tail slot 22 in the disk 12, and has a lug 24 which contacts the base 26 of the slot 22, spacing the underside surface 34 of each platform 18 a minimum distance D from the disk rim 28. The platform underside surface 34 is inclined radially outwardly, in opposite axial directions, away from the blade root 16. As is seen in FIG. 2, one side of the platform surface 34 is inclined radially outwardly in the forward axial direction, and the other side is inclined radially outwardly in the rarward axial direction. As is seen in FIG. 4, each blade platform has oppositely facing, axially extending and spaced apart ends 30, 32, FIG. 4. The ends 30, 32 of adjacent blades 14 are slightly spaced apart, and define a narrow gap G axially extending therebetween.

The dove tail slot 22 extends circumferentially about the rim 28, and includes a circumferential seal retaining recess 40, FIG. 2. The recess 40 has axially opposed sidewalls 42, 44. Each blade platform 18 extends axially, in the forward and rearward directions, past the sidewalls 42, 44 of the seal recess 40.

A flexible, annular seal 46 is disposed radially inwardly of the blade platforms 18, within the recess 40. Referring to FIG. 3, the seal 46 has forward and rearward circumferentially extending, axially spaced apart strips 50, 52, respectively, and a plurality of circumferentially spaced apart crossbars 54 extending axially from the forward strip 50 to the rearward strip 52, and integral with both strips 50, 52. The opening 56 between adjacent crossbars 54 receives the root 16 of each blade 14, and one crossbar 54 overlies the gap G between adjacent blades 14, FIG. 4. The forward seal strip 50 is disposed axially adjacent to the recess forward sidewall 42, and the rearward seal strip 52 is disposed axialy adjacent to the recess rearward sidewall 44. Each strip 50, 52 has a circumferential flange 58, 60, respectively, which extends radially inwardly therefrom, and which supports the seal upon a radially outwardly facing recess surface 48. In the static condition, each flange 58, 60 is slightly axially spaced from its respective recess sidewall 42, 44, and the seal 46 is radially spaced from the platform underside surface 34. As will be described hereinbelow, during engine operation, the seal 46 limits the leakage of working medium gases which could move from the gas flow path, between the blade platforms 18 (through the axially extending gaps G) and through the blade retaing slot 22, as shown by the arrows 62 in FIG. 4. The seal 46 also limits the leakage of gases which could move beneath the blade platforms 18 (through the circumferentially extending gaps D) and through the blade retaining slot 22, as shown by the arrows 64 in FIG. 2.

Figure 6:
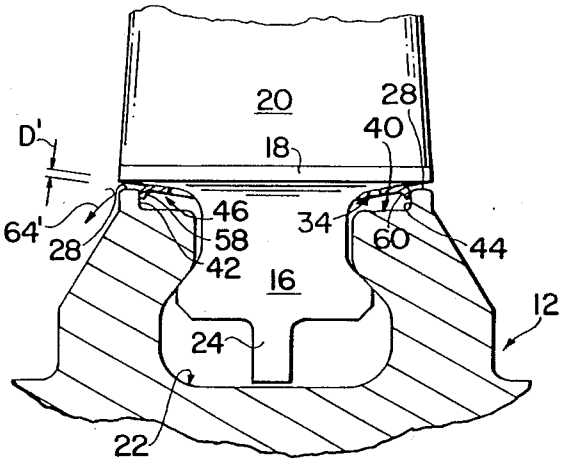
FIG. 6 is a view corresponding to FIG. 2, showing the rotor assembly in its operating mode.
Figure 5:
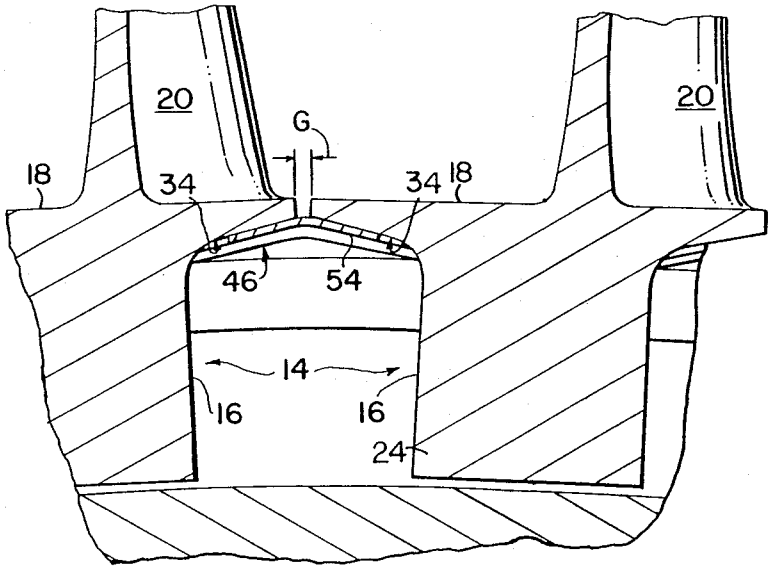
FIG. 5 is a view corresponding to FIG. 4, showing the rotor assembly in its operating mode.

During operation of the engine, as the rotor assembly 10 rotates about the engine axis, each blade 14 and the seal 46 move radially outwardly in response to centrifugal forces, and the seal 46 comes to bear tightly against the underside surface 34 of each platform 18, FIGS. 5–6. FIG. 5 shows that each crossbar 54 bends into a V-shape, so as to conform to the shape of adjacent underside surfaces 34. Tight contact between the crossbars 54 and the underside surfaces 34 limits the leakage of working medium gases through the axially extending gaps G. FIG. 6 shows that as the seal 46 moves radially outwardly and the crossbars 54 bend, the strip flanges 58, 60 move radially as well as axially. Both flanges 58, 60 move until they come into tight contact with their respective sidewall 42, 44. Such contact limits the leakage of working medium gases through the circumferentially extending gaps D'.

In this exemplary embodiment, in the as-fabricated condition, the seal flanges 58, 60 are perpendicular to the strips 50, 52 and have a thickness, t, which is equal to the thickness of the strips 50, 52 and the crossbars 54, FIG. 3. However, the scope of the present invention is not limited to a seal having this particular shape, but also includes other shapes, some of which are shown in FIGS. 7A–7C. In all embodiments, the length L of the flanges 58, 60 (and the corresponding flanges 58*a*, 58*b*, 58*c*, 60*a*, 60*b*, 60*c* of FIGS. 7A–7C, respectively) must be greater than the distance D' (FIG. 6) so that when each seal crossbar 54 (and the corresponding crossbars 54*a*, 54*b*, 54*c*) sealing contacts the underside surfaces 34 of adjacent blade platforms 18, the flanges will be long enough to simultaneously, sealingly engage their respective recess sidewall 42, 44. If the seal 46 (and the corresponding seal 46*a*, 46*b*, 46*c*) should fracture during engine operation, the seal pieces will be retained within the recess 40, trapped therein by the flanges in contact with the sidewalls 42, 44.

Although the invention has been shown and described with respect to a preferred embodiment thereof, it should be understood by those skilled in the art that other various changes and omissions in the form and detail thereof may be made therein without departing from the spirit and scope of the invention.

We claim:

1. A gas turbine engine rotor assembly comprising:

(a) an annular rotor disk having a rim and a blade retaining slot extending circmferentially about said rim, said disk having an axis, and said slot having a base and opposed, axially spaced apart sidewalls;

(b) a plurality of rotor blades arranged in a circumferential row about said disk rim, each blade having a blade root disposed within said slot and a platform spaced radially outwardly of said root, said platforms of adjacent blades having an axially extending gap therebetween, each platform having a radially inwardly facing underside surface inclined radially outwardly in opposite axial directions away from said root, said underside surface radially spaced from said rim so as to define a circumferentially extending gap therebetween; and (c) an annular ladder seal disposed radially inwardly of said blade platforms and between said platforms and said slot base, said seal having a pair of axially spaced apart, circumferentially extending strips and a plurality of circumferentially spaced apart crossbars extending axially from one strip to the other and integral with both strips, each strip having a circumferential, radially inwardly extending flange axially adjacent to one of said slot sidewalls, wherein said seal is adapted to bend due to centrifugal forces during engine operation such that each of said crossbars contacts said underside surfaces of adjacent blade platforms to seal said gap extending axially between said platforms, and each flange moves radially outwardly as well as axially and contacts its respective slot sidewall to seal said gap extending circumferentially between said rim and said platform underside surfaces.

2. The assembly of claim 1, wherein said seal is adapted to simultaneously contact said platform underside surfaces and said slot sidewalls during engine operation as to simultaneously seal each circumferentially extending gap and each axially extending gap.

3. The assembly of claim 2, wherein said blade retaining slot includes a circumferentially extending seal retaining recess, and said seal is disposed within said recess.

* * * * *